US005880393A

United States Patent [19]

Kaneko et al.

[11] Patent Number: 5,880,393

[45] Date of Patent: Mar. 9, 1999

[54] KEYBOARD MUSICAL INSTRUMENT AND RECORDER/PLAYBACK CONTROLLER INCORPORATED THEREIN

[75] Inventors: Yasutoshi Kaneko; Kiyoshi Kawamura, both of Shizuoka, Japan

[73] Assignee: Yamaha Corporation, Hamamatsu, Japan

[21] Appl. No.: 982,625

[22] Filed: Dec. 2, 1997

[30] Foreign Application Priority Data

Dec. 4, 1996 [JP] Japan ..... 8-324380

[51] Int. Cl.[6] ..... G10H 1/02; G10H 5/00

[52] U.S. Cl. ..... 84/662; 84/21; 84/724

[58] Field of Search ..... 84/19–21, 23, 84/626, 662, 724

[56] References Cited

U.S. PATENT DOCUMENTS 5,324,883 6/1994 Kondo ..... 84/23 X
5,357,047 10/1994 Isozaki et al. ..... 84/21 X
5,612,502 3/1997 Ura ..... 84/21 X

FOREIGN PATENT DOCUMENTS 59-114593 7/1984 Japan .
2-262196 10/1990 Japan .

*Primary Examiner*—William M. Shoop, Jr.
*Assistant Examiner*—Jeffrey W. Donels
*Attorney, Agent, or Firm*—Graham & James LLP

[57] ABSTRACT

An acoustic piano, solenoid-operated key actuators for moving black/white keys in response to a driving signal and an electric system form in combination a keyboard musical instrument, and the electric system previously establishes first relations between key motions and associated hammer motions and second relations between the magnitude of the driving signal and final hammer velocity; the electric system estimates the final hammer velocity and a time delay between a key-on timing and an impact timing on the basis of the first relations for producing pieces of music data information in a recording mode, and tailors the driving signal on the basis of the second relations in a playback mode for exactly reproducing the original performance.

14 Claims, 12 Drawing Sheets

| | FC1 | FC2 |
|---|---|---|
| L4 | ON | ON |
| L3 | ON | OFF |
| L2 | OFF | OFF |
| L1 | OFF | ON |

KEYBOARD MUSICAL INSTRUMENT AND RECORDER/PLAYBACK CONTROLLER INCORPORATED THEREIN

FIELD OF THE INVENTION

This invention relates to a keyboard musical instrument and, more particularly, to a keyboard musical instrument and a recorder and/or a playback controller incorporated therein.

DESCRIPTION OF THE RELATED ART

A kind of keyboard musical instrument estimates a hammer velocity and an impact timing on the basis of the motion of a depressed key. A typical example of the keyboard musical instrument is disclosed in the specification and the drawings attached to Japanese Patent Application No. 1-83806. The prior art keyboard musical instrument includes key sensors provided for black/white keys and a controller connected to the key sensors. The key sensor detects current key position of the associated black/white key, and informs the controller of the current key position. While a black/white key is being depressed, the current key position is varied with time, and the associated key sensor varies the key position signal representative of the current key position. The controller has a table defining the relation between the key velocity and a final hammer velocity at an impact against the strings, and estimates the final hammer velocity and the impact timing.

Another kind of keyboard musical instrument is known as a automatic player piano. The automatic player piano is equipped with solenoid-operated key actuators provided under the keyboard and a controller. Music data codes are representative of an original performance, and are supplied to the controller. The controller produces driving current signals from the music data codes, and supplies the driving current signals to the solenoid-operated key actuators. The solenoid-operated key actuators selectively move the associated black/white keys, and reproduce the original performance. The force exerted on the black/white key is varied by changing the electric power of the driving current signal, and the hammer is controlled as similar to that in the original performance.

However, the automatic player piano has individualities due to the differences of component parts and the solenoid-operated key actuators. Even if the music data codes are supplied in parallel to different products of a certain model, the original performance is differently reproduced therebetween. An individualization technology is disclosed in Japanese Patent Publication of Unexamined Application No. 59-114593. The controller supplies a test signal to the solenoid-operated key actuator, and measures the key velocity. The controller determines the relation between the test signal and the actual key velocity, and modifies contents of a table defining the relation between the magnitude of driving current signal and the key velocity so as to individualize the automatic player piano. In a reproduction of original performance, when a music data code is supplied to the controller, the controller checks the table so as to determine the magnitude of the driving current signal, and supplies the driving current signal, the magnitude of which is modified from that of an ideal automatic player piano, to the solenoid-operated key actuator associated with a key to be driven.

The first prior art keyboard musical instrument estimates the final hammer and the impact timing on the basis of the directly measured key velocity. However, the table defines the relation between the key velocity and the final hammer velocity for an ideal keyboard musical instrument, and the individuality, aged deterioration and variation of environment are never taken into account. These factors have influence on the relation defined in the table, and the influence is different between products.

If hammer sensors are respectively provided for the hammers together with the key sensors, it is possible to adjust the contents of the table to the actual relation between the key velocity and the hammer velocity. However, eighty-eight keys usually form the keyboard, and the hammer sensors for the eighty-eight hammers increase the production cost of the keyboard musical instrument. Moreover, it is impossible to attach the hammer sensors inside the keyboard musical instrument after delivery to user.

The prior art individualization technology gives rise to a hammer velocity on the basis of a given music data code, and makes a reproducing performance close to the original performance. However, the key action mechanisms per se have individuality, and the relation between the key velocity and the final hammer velocity is different between the individual black/white keys. Moreover, the aged deterioration and the environmental does not uniformly affect the transmission line from the black/white keys to the hammers, and difference between an actual impact timing and the impact timing represented by the music data code is never taken into account. For this reason, the prior art automatic player piano does not exactly reproduce an original performance.

SUMMARY OF THE INVENTION

It is therefore an important object of the present invention to provide a keyboard musical instrument, which reproduces a performance exactly consistent with an original performance.

In accordance with one aspect of the present invention, there is provided a keyboard musical instrument comprising an acoustic keyboard instrument including a plurality of keys movable between respective rest positions and respective end positions, a plurality of vibrating means for producing acoustic sounds having respective notes of a scale, and a plurality of striking means selectively driven by the plurality of keys so as to cause the plurality of vibrating means to produce the acoustic sounds; and an electric system selectively entering into a regulating mode and a first performance mode, and including a first detecting means activated in the regulating mode and the first performance mode for producing first pieces of data information representative of first motions of the plurality of keys, a second detecting means activated in the regulating mode for producing second pieces of data information representative of second motions of the plurality of striking means, a first analyzing means activated in the regulating mode and analyzing the first motions and the second motions for determining first relations therebetween, and a music data generating means activated in the first performance mode and modifying the first pieces of data information with the first relations for producing pieces of music data information representative of a performance on the plurality of keys.

In accordance with another aspect of the present invention, there is provided a keyboard musical instrument comprising an acoustic keyboard instrument including a plurality of keys movable between respective rest positions and respective end positions, a plurality of vibrating means for producing acoustic sounds having respective notes of a scale, and a plurality of striking means selectively driven by the plurality of keys so as to cause the plurality of vibrating means to produce the acoustic sounds; and an electric system selectively entering into a regulating mode and a performance mode for reproducing a performance on the plurality of keys, and including a plurality of actuators respectively associated with the plurality of keys and responsive to a driving signal in the regulating mode and the performance mode for selectively moving the associated keys, a detecting means activated in the regulating mode for producing pieces of data information representative of motions of the plurality of striking means, an analyzing means analyzing the motions of the plurality of striking means and a piece of test data information in the regulating mode for determining relations therebetween, and an automatic playing means responsive to the piece of test data information in the regulating means for producing the driving signal and modifying pieces of music data information representative of the performance with the relations in the performance mode for producing the driving signal.

In accordance with yet another aspect of the present invention, there is provided a recorder incorporated in a keyboard musical instrument together with a plurality of keys movable between respective rest positions and respective end positions, a plurality of vibrating means for producing acoustic sounds having respective notes of a scale and a plurality of striking means selectively driven by the plurality of keys so as to cause the plurality of vibrating means to produce the acoustic sounds, and the recorder comprises a first detecting means activated for producing first pieces of data information representative of first motions of the plurality of keys, a second detecting means activated for producing second pieces of data information representative of second motions of the plurality of striking means, an analyzing means analyzing the first motions and the second motions for determining relations therebetween and a music data generating means modifying the first pieces of data information with the relations for producing pieces of music data information representative of a performance on the plurality of keys.

In accordance with still another aspect of the present invention, there is provided a playback controller incorporated in a keyboard musical instrument together with a plurality of keys movable between respective rest positions and respective end positions, a plurality of vibrating means for producing acoustic sounds having respective notes of a scale and a plurality of striking means selectively driven by the plurality of keys so as to cause the plurality of vibrating means to produce the acoustic sounds, and the playback controller selectively enters into a regulating mode and a performance mode and includes a plurality of actuators respectively associated with the plurality of keys and responsive to a driving signal in the regulating mode and the performance mode for selectively moving the associated keys, a detecting means activated in the regulating mode for producing pieces of data information representative of motions of the plurality of striking means, an analyzing means analyzing the motions of the plurality of striking means and a piece of test data information in the regulating mode for determining relations therebetween and an automatic playing means responsive to the piece of test data information in the regulating means for producing the driving signal and modifying pieces of music data information representative of a performance with the relations in the performance mode for producing the driving signal.

BRIEF DESCRIPTION OF THE DRAWINGS

The features and advantages of the keyboard musical instrument and the recorder/playback controller will be more clearly understood from the following description taken in conjunction with the accompanying drawings in which.

DESCRIPTION OF THE PREFERRED EMBODIMENT

Figure 1:
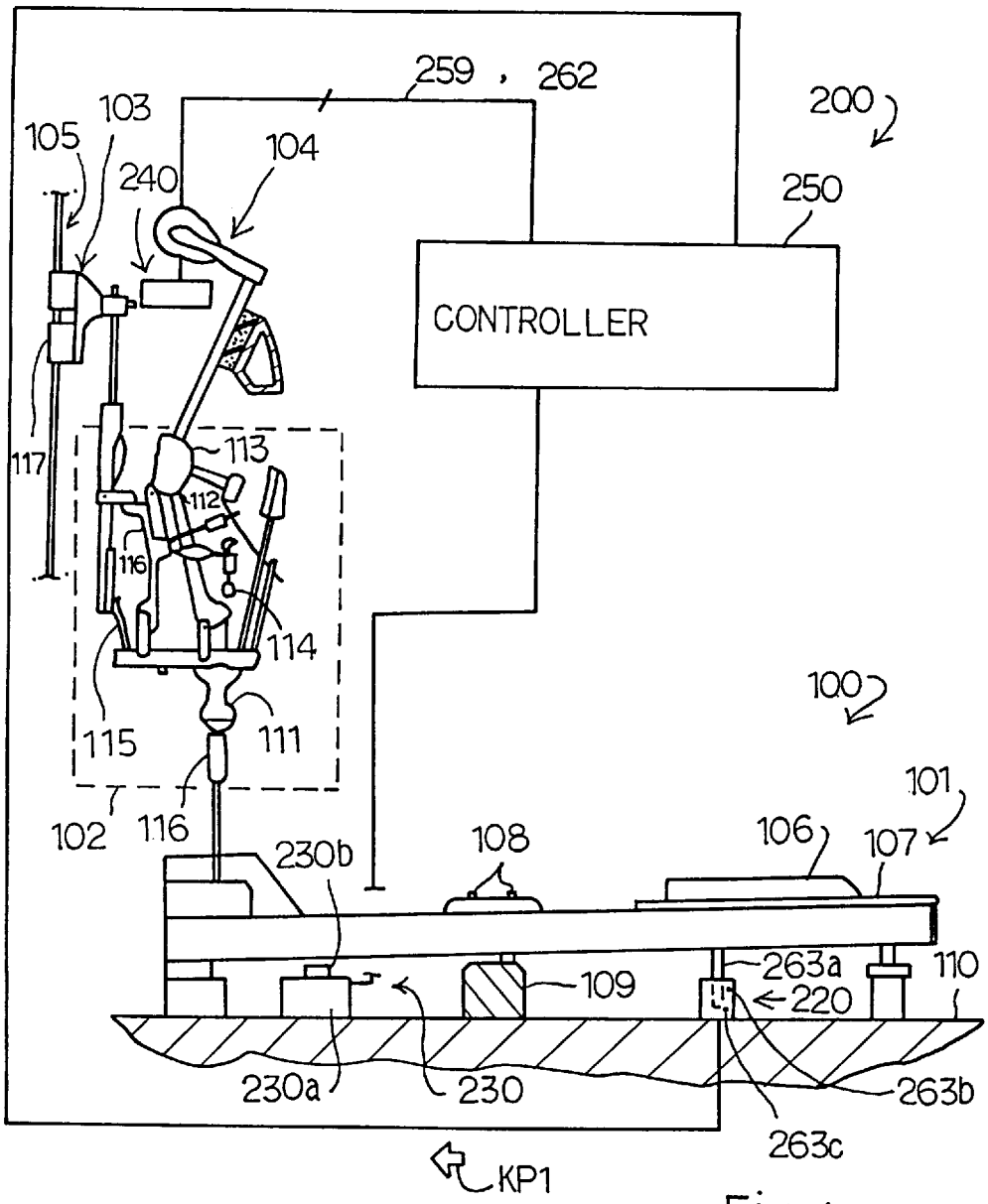
FIG. 1 is a schematic view showing the structure of a keyboard musical instrument according to the present invention.

Referring first to FIG. 1 of the drawings, a keyboard musical instrument embodying the present invention largely comprises an acoustic piano 100, an electric system 200, and serves as an automatic player piano. The acoustic piano 100, the recording system 200 and the playback system 300 are detailed hereinbelow.

Structure of Acoustic Piano

The acoustic piano 100 is an upright piano, and includes a keyboard 101, key action mechanisms 102, damper mechanisms 103, hammer assemblies 104 and sets of strings 105. Although a pedal mechanism for a damper pedal and a soft pedal is further incorporated in the acoustic piano 100, the pedal mechanism is not shown in FIG. 1 for the sake of simplicity.

The upright piano is a standard type. Eighty-eight black/white keys 106/107 form in combination the keyboard 101, and are turnable with respect to associated balance key pins 108, respectively. The balance key pins 108 project from a balance rail 109, which laterally extend over a key bed 110. While no force is exerted one the black/white keys 106/107, the black/white keys 106/107 are in respective rest positions. A player depresses a front portion of the black/white key 106/107, the force gives rise to a downward motion, and the depressed black/white key 106/107 reaches an end position.

The key action mechanisms 102 are respectively associated with the black/white keys 106/107, and each key action mechanism 102 includes a whippen assembly 111, a jack 112, a hammer butt 113, a regulating button 114 and a damper spoon 115. The hammer butt 113 is turnably supported by a center rail 116, and the hammer assembly 104 is implanted into the hammer butt 113. The whippen assembly 111 is engaged with a capstan button 116 upright from the rear end portion of associated black/white key 106/107, and the capstan button 116 transmits the force to the key action mechanism 102. The jack 112 is engaged with the hammer butt 113, and pushes up the hammer butt 113 until the contact with the regulating button 114. Upon contact with the regulating button 114, the jack 112 kicks the hammer butt 113, and the hammer butt 113 escapes from the jack 112. The hammer butt 113 and, accordingly, the hammer assembly 104 start a free rotation around the center rail 116, and the hammer assembly 104 strikes the associated set of strings 105.

The damper mechanisms 103 are respectively associated with the black/white keys 106/107 and the sets of strings 105. The damper mechanism 103 is urged to turn in the counter clockwise direction, and is held in contact with the damper spoon 115. The damper mechanism 103 has a damper head 117 in order to take up vibrations of the strings 105. When the black/white key 106/107 is in the rest position, the damper head 117 is held in contact with the set of strings 105, and does not allow the set of strings 105 to vibrate. While the black/white key 106/107 is being moved from the rest position to the end position, the damper spoon 115 pushes the damper mechanism 103, and spaces the damper head 117 from the set of strings 105 in order to allow the set of strings 105 to vibrate. The damper spoon 115 brings the damper head 117 into contact with the set of strings 105 on the way from the end position to the rest position, and the damper head 117 takes up the vibrations. Thus, the acoustic piano behaves as similar to a standard upright piano.

Electric System

Figure 2:
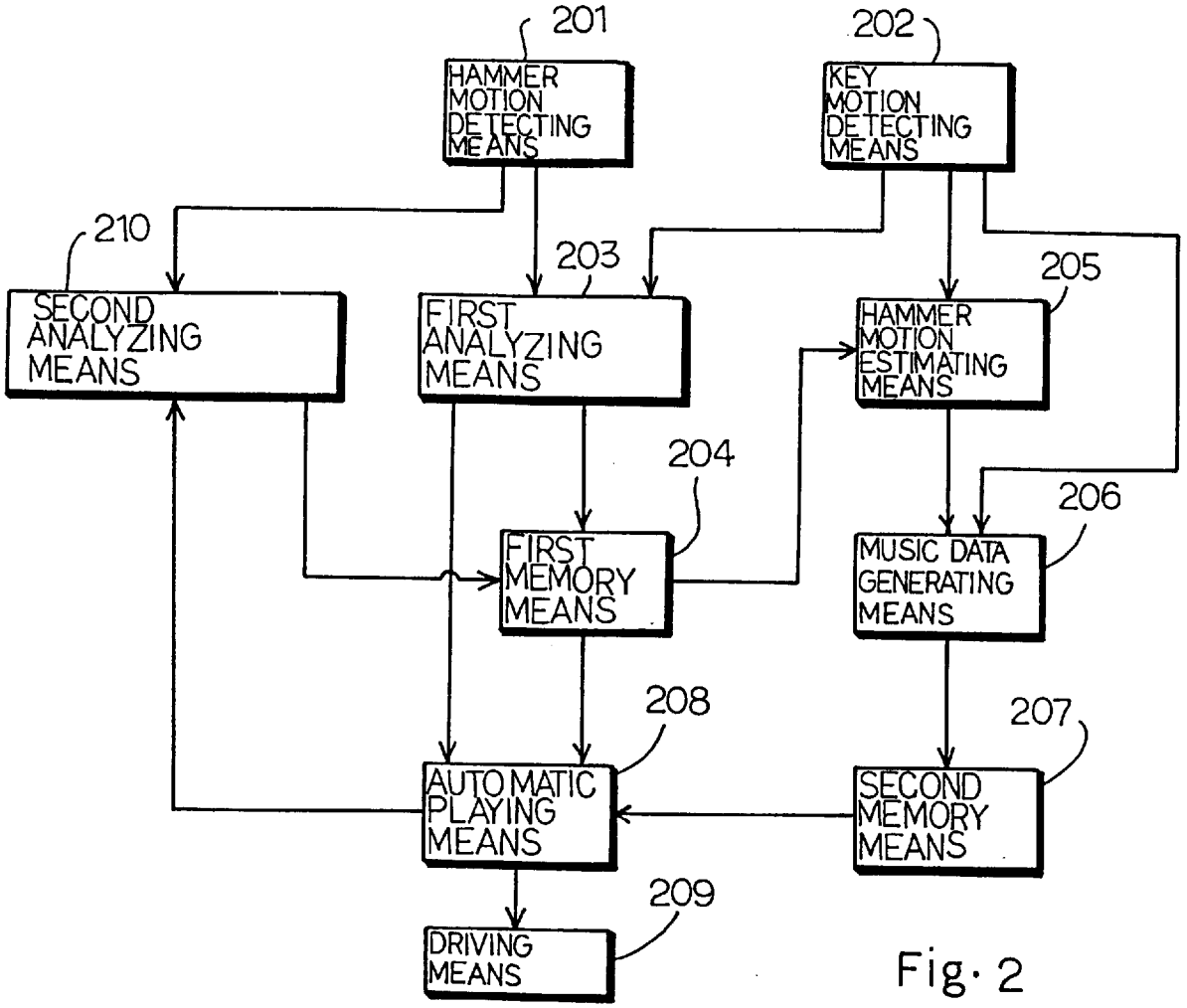
FIG. 2 is a block diagram showing the arrangement of an electric system incorporated in the keyboard musical instrument.

FIG. 2 illustrates the electric system 200 incorporated in the keyboard musical instrument. Reference numeral 201 designates a hammer motion detecting means, and the hammer motion detecting means 201 determines a final hammer velocity and an impact timing. The final hammer velocity and the impact timing represent a hammer motion of a hammer assembly 103 to be analyzed, and the hammer motion detecting means produces first pieces of data information representative of the hammer motion.

Reference numeral 202 designates a key motion detecting means, and the key motion detecting means 202 determines a key-on timing and a key velocity for a depressed black/white key 106/107 associated with the hammer assembly 103. The key-on tinning and the key velocity represent a key motion of the depressed black/white key 106/107, and the key motion detecting means 202 produces second pieces of data information representative of the key motion.

Reference numeral 203 designates a first analyzing means. The hammer motion detecting means 201 supplies the final hammer velocity and the impact timing to the first analyzing means 203, and the key motion detecting means 202 supplies the key-on timing and the key velocity to the first analyzing means 203. The first analyzing means 203 analyzes the hammer motion and the key motion in order to establish first relations between the key motion and the hammer motion. The first analyzing means 203 produces third pieces of data information representative of the first relations. The first analyzing means 203 stores pieces of test data information described hereinlater.

Reference numeral 204 designates a first memory means. The first analyzing means 203 supplies the third pieces of data information to the first memory means 204, and the first pieces of data information are stored in the first memory means 204.

Reference numeral 205 designates a hammer motion estimating means. The key motion detecting means 202 and the first memory means 204 supply the first pieces of data information and the third pieces of data information to the hammer motion estimating means 205. The hammer motion estimating means 205 applies the first relations to the first pieces of data information, and estimates a hammer motion. The hammer motion estimating means 205 forms the estimated hammer motion into fourth pieces of data information.

Reference numeral 206 designates a music data generating means. The key motion detecting means 202 and the hammer motion estimating means 205 supply the second pieces of data information and the fourth pieces of data information to the music data generating means 206, and the music data generating means 206 produces pieces of music data information from the second pieces of data information and the fourth pieces of data information. The pieces of music data information represent an original performance or a score to be played.

Reference numeral 207 designates a second memory means 207. The music data generating means 206 supplies the pieces of music data information to the second memory means 207, and the pieces of music data information are stored in the second memory means 207.

Reference numerals 208 and 209 designate an automatic playing means and a plurality of driving means provided for the black/white keys 106/107 for moving them without a fingering on the keyboard, and reference numeral 210 designates a second analyzing means 210. When the first analyzing means 203 supplies the pieces of test data information to the automatic playing means 208, the automatic playing means 208 produces pieces of test driving data information from the pieces of test data information, and tailors test driving signals from the pieces of test driving data information. The automatic playing means 208 supplies the test driving signals to the plurality of driving means 209 and the pieces of test driving data information to the second analyzing means 210. The driving means 209 are responsive to the test driving signals so as to move the black/white keys 106/107. The black/white key 106/107 actuates the key action mechanism 102 and the damper mechanism 103, and the hammer assembly 104 is driven for rotation as described hereinbefore. The hammer motion detecting means 201 determines the first pieces of data information representative of the hammer motion, and supplies the first pieces of data information to the second analyzing means 210. The automatic playing means 208 supplies the pieces of test driving data information to the second analyzing means 210, and the second analyzing means 210 analyzes the hammer motion in order to establish second relations between the pieces of test driving data information and the first pieces of data information. The second relations are formed into pieces of fifth data information, and the pieces of fifth data information are stored in the first memory means 204.

While the automatic playing means 208 is reading out the pieces of music data information from the second memory means 207 for reproducing the original performance, the first memory means 204 supplies the pieces of fifth data information representative of the second relations, and the automatic playing means 208 applies the second relations to the pieces of music data information. For this reason, the pieces of music data information are modified, and the automatic playing means 208 determines pieces of actual driving information on the basis of the modified pieces of music data information, and produces actual driving signals. The actual driving signals are selectively supplied to the driving means 209, and the driving means 209 move the associated black/white keys 106/107 for reproducing the original performance.

The keyboard musical instrument has four operation modes, and a player instructs the electric system 200 to enter selected one of the four operation modes, i.e., an acoustic playing mode, a regulating mode, a recording mode and a playback mode. In the selected operation mode, the keyboard musical instrument behaves as follows.

When a player selects the acoustic playing mode, the means 201 to 209 are disabled, and are never responsive to a fingering on the keyboard 101. Nevertheless, the mechanical parts 102, 103 and 104 are sequentially actuated by the depressed black/white keys 106/107, and the hammer assemblies 103 strike the sets of strings 105. The sets of strings 105 vibrate, and generate the acoustic sounds.

When the player instructs the electric system 200 to enter into the regulating mode, the electric system 200 is expected to establish the first relations between the key motion and the hammer motion and the second relations between the pieces of test driving data information and the first pieces of data information.

The first analyzing means 203 supplies the pieces of test data information to the automatic playing means 208, and the automatic playing means 208 determines the pieces of test driving data information. The automatic playing means 208 tailors the test driving signals, and supplies the plurality of driving means 209, respectively. The driving means 209 actuate the associated black/ white keys 106/107, respectively, and the black/white keys 106/107 actuate the associated key action mechanisms 102. The hammer assemblies 104 are driven for rotation by the associated key action mechanisms 102, and strike the sets of strings 105.

The key motion detecting means 202 detects the key-on timing and the key velocity, and produces the second pieces of data information. On the other hand, the hammer motion detecting means 201 detects the final hammer velocity and the impact timing, and produces the first pieces of data information. The first pieces of data information and the second pieces of data information are supplied to the first analyzing means 203, and the first analyzing means 203 determines the first relations between the key motion and the hammer motion. On the other hand, the pieces of test driving data information and the first pieces of data information are supplied to the second analyzing means 210, and the second analyzing means 210 determines the second relations between the pieces of test driving data information and the first pieces of data information. The first relations define the individuality of each power transmission line, i.e., the black/ white key 106/107, the key action mechanism 102, the hammer mechanism 103 and the hammer assembly 104, and the second relations define the individuality of each driving means 209.

The first relations and the second relations are stored in the first memory means 204 as the third pieces of data information and the fifth pieces of data information.

Assuming now that the player selects the recording mode, the key motion detecting means 202 detects depressed black/white keys 106/107, and produces a plurality of sets of the second pieces of data information. Each set of the second pieces of data information represents the motion of one of the depressed black/white keys 106/107. The sets of second pieces of data information are supplied from the key motion detecting means 202 to the hammer motion estimating means 205, and the hammer motion estimating means 205 applies the first relations to the sets of second pieces of data information, and produces sets of the fourth pieces of data information. The sets of second pieces of data information and the associated sets of fourth pieces of data information are supplied to the music data generating means 206, and the music data generating means 206 produces sets of the pieces of music data information representative of the performance. The sets of pieces of music data information are supplied to the second memory means 207, and are stored therein.

In the playback mode, the automatic playing means 208 reads out the sets of pieces of music data information from the second memory means 207, and modifies the sets of pieces of music data information to sets of pieces of actual driving data information on the basis of the second relations. The automatic playing means 208 tailors the actual driving signals, and selectively supplies them to the driving means 209. The driving means 209 selectively moves the black/ white keys 106/107, and causes the associated hammer assemblies 104 to strike the sets of strings 105.

Turning back to FIG. 1 of the drawings, key sensors 220, solenoid-operated key actuators 230, hammer sensors 240 and a controller 250 form the electric system 200. The hammer sensors 240 and the key sensors 220 form parts of the hammer motion detecting means 201 and parts of the key motion detecting means, respectively, and the solenoid-operated key actuators 230 serve as the driving means 209. The other means 203, 205, 206, 208 and 210 are implemented by the controller 250 and suitable software as will be described hereinlater.

Figure 3:
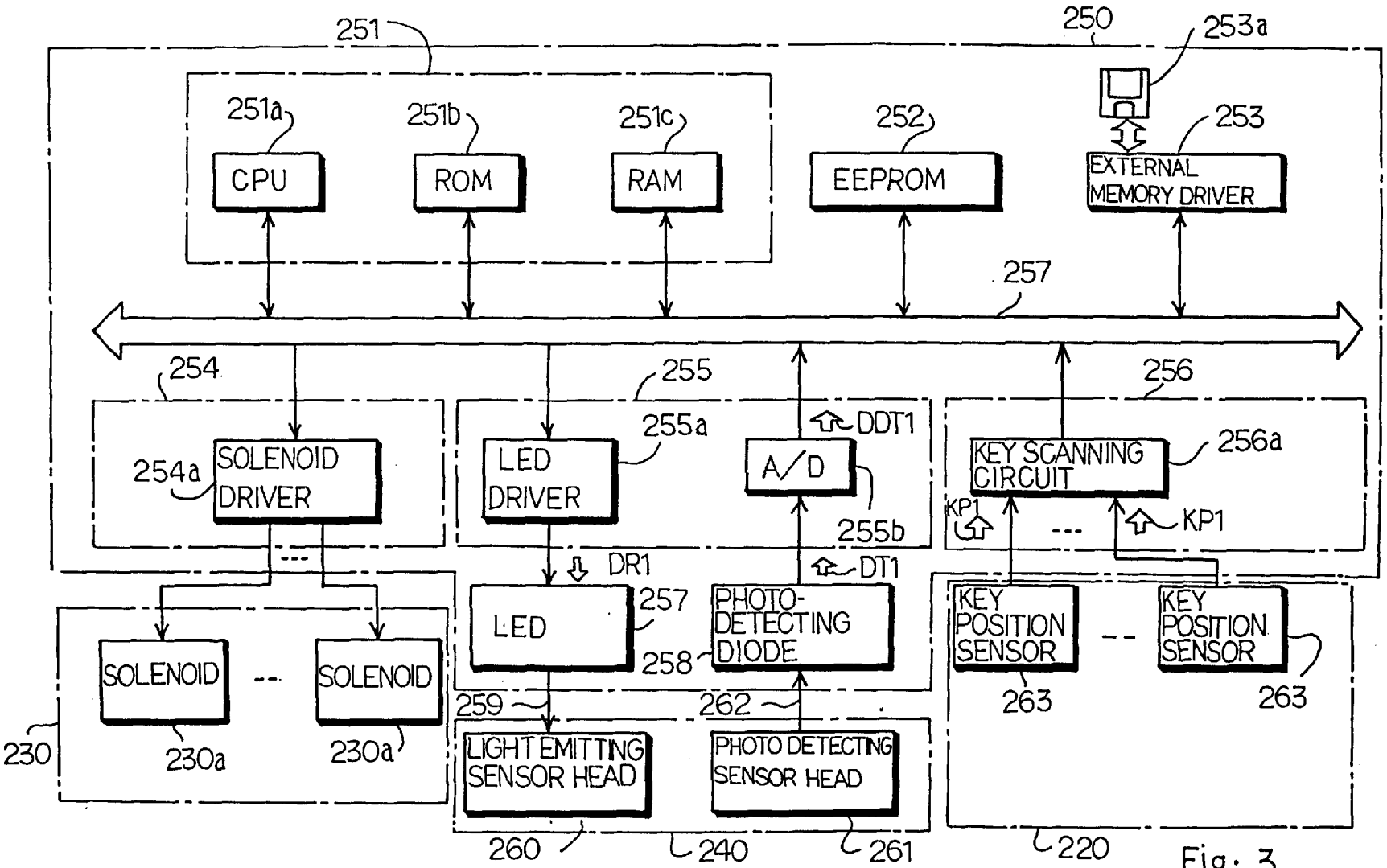
FIG. 3 is a block diagram showing the arrangement of a controller and sensors incorporated in the keyboard musical instrument.

FIG. 3 illustrates the arrangement of the controller 250 connected to the key sensors 220, the hammer sensors 240 and the solenoid-operated key actuators 230. The controller 250 includes a data processor 251, a built-in memory device 252, an external memory driver 253, a first interface 254 to the solenoid-operated key actuators 230, a second interface 255 to the hammer sensors 240, a third interface 256 to the key sensors 220, a light emitting diode) 257 and a photo-detecting diode 258. The component units 251 to 256 are connected to a shared bus system 257, and the data processor 251 communicates with the other components units 252 to 256 through the shared bus system 257. The built-in memory 252 is implemented by EEPROM (Electrically Erasable and Programmable Read Only Memory), and the external memory driver 253 may be a floppy disk driver, an opt-magnetic disk driver, a compact disk read/write driver or a RAM cartridge. An information storage medium such as a floppy disk 253*a* or a compact disk is loaded into or unloaded from the external memory driver 253, and data information is stored therein.

The data processor 251 includes a central processing unit 251*a*, a read-only memory 251*b* and a random access memory 251*c*. A programmed instruction codes are stored in the read only memory 251*b*, and the central processing unit 251*a* fetches the programmed instruction codes. The read-only memory 251*b* stores programmed instruction codes executed by the central processing unit 251*a*, and the pieces of test data information are also stored in the read only memory 251*b*. The programs are described hereinlater in detail. The random access memory 251*c* serves as a temporary memory.

The first interface 254 includes a solenoid driver 254*a*. The solenoid driver 254*a* is responsive to the pieces of test driving data information and the pieces of actual driving data information so as to produce the test driving signals and the actual driving signals. The test/actual driving signals are selectively supplied to the solenoids 230*a* of the solenoid-operated key actuators 230, and causes the solenoids 230*a* to exert magnetic force on plungers 230*b*. As a result, the plungers 230*b* upwardly project from the solenoids 230*a*, respectively, and move the black/white keys 106/107 as if a player depresses them.

The second interface 255 includes an LED (Light Emitting Diode) driver 255*a* and an analog-to-digital converter 255*b*. The LED driver 255*a* is connected to the light emitting diode 257, and the light emitting diode 257 is connected through an optical fiber 259 (see FIG. 1) to a light-emitting sensor head 260. On the other hand, a photo-detecting diode 258 is connected to the analog-do-digital converter 255*b*. A photo-detecting sensor head 261 is opposed to the light emitting sensor head 260 through the trajectories of the hammer assemblies 104, and are connected to the photo-detecting diode 258 through an optical fiber 262. The light emitting sensor head 260 radiates a parallel light beam across the trajectories of hammer assemblies to the photo-detecting sensor head 261, and the photo-detecting sensor head 261 concentrates the incident light beam onto the optical fiber 262. In this instance, the light beam ranges from 2 millimeters to 10 millimeters in diameter.

The LED driver 255*a* supplies a driving current signal DR1 to the light-emitting diode 257, and the light emitting diode 257 generates light. The light is propagated through the optical fiber 259 to the light emitting sensor head 260, and the light emitting sensor head 260 radiates a light beam toward the photo detecting sensor head 261. When the light beam is interrupted by the hammer assembly 104, the photo-detecting diode 258 minimizes a detecting voltage signal DT. However, if the light beam is incident into the associated photo-detecting sensor head 261 without the interruption, the photo-detecting diode 258 maximizes the detecting voltage signal DT1, and the analog-to-digital converter 255*b* converts the detecting voltage signal DT1 to a digital detecting signal DDT1.

The third interface 256 includes a key scanning circuit 256*a*, and the key scanning circuit 256*a* is connected to key position sensors 263. The key position sensors 263 are associated with the black/white keys 106/107, respectively, and serve as the key sensors 220. The key sensor 263 monitors the associated black/white key 106/107, and produces a key position signal KP1 indicative of a current key position. The key scanning circuit 256*a* sequentially checks the key position sensors 263 to see whether or not the associated black/white keys 106/107 change the current key positions.

The LED driver 255*a*, the light emitting diode 257, the light emitting sensor head 260, the photo detecting sensor head 261, the photo-detecting diode 258 and the analog-to-digital converter 255*b* form the hammer motion detecting means 201, and the key scanning circuit 256*a* and the key position sensors 263 as a whole constitute the key motion detecting means 202. The first analyzing means 203, the hammer motion estimating means 205, the music data generating means 206, the automatic playing means 208 and the second analyzing means 210 are implemented by the data processor —251 and the programmed instructions stored in the read only memory 251*b*. The built-in memory 252 serves as the first memory means 204, and the solenoid driver 254*a* and the solenoid-operated key actuators 230 as a whole constitute the driving means 209. The second memory means 207 is corresponding to the random access memory 251*c* or the combination of the external memory driver 253 and the information storage medium 253*a*.

Hammer Sensor

Figure 4:
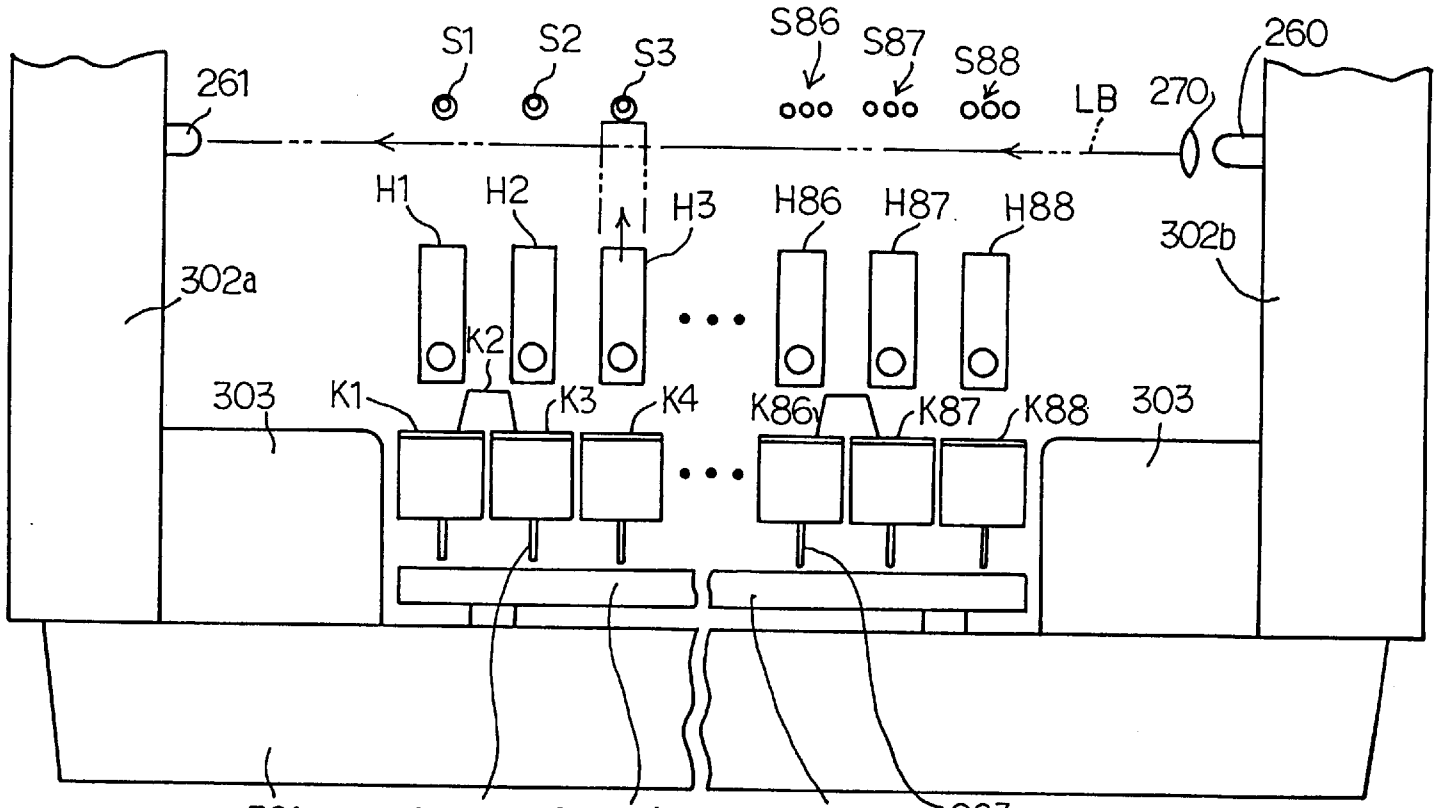
FIG. 4 is a front view showing the arrangement of black/white keys and hammers incorporated in the keyboard musical instrument.

FIG. 4 illustrates the arrangement of black/white keys and hammer assemblies. Although the hammer sensors 240 are installed in a grand piano, the arrangement is applicable to the upright piano 100. In FIG. 4, reference numerals 300, 301 and 302*a*/302*b* designate a key bed, side arms and key blocks, respectively. Black/white keys K1, K2, K3, . . . K86, K87 and K88 are arranged between the key blocks 303, and are linked with hammer assemblies H1, H2, H3, . . . H86, H87 and H88 through key action mechanisms (not shown). The position of the hammer assembly farthest from the associated string is hereinbelow referred to as "home position". The hammer assemblies H1 to H88 are opposed to strings S1, S2, S3, . . . S86, S87 and S88. When a player depresses one of the black/white keys K1 to K88, the associated hammer assembly is driven for rotation, and strikes the associated string. The trajectories of the hammer assemblies H1 to H88 are on virtual planes parallel to one another.

The light-emitting sensor head 260 is attached to the inner surface of the side arm 302*b*, and the photo-detecting sensor head 261 is attached to the inner surface of the other side arm 302*a*. The light-emitting sensor head 260 radiates the light beam LB ranging from 2 millimeters to 10 millimeters in diameter, and bridges the space between the side arms 302*a* and 302*b*. The light beam LB passes beneath the strings S1 to S88, and a lens 270 makes the light beam parallel light. The ratio of the radiated light to the received light is of the order of 100 percent. In order to share the light beam LB between the hammer assemblies H1 to H88, the light-emitting sensor head 260, the lens 270 and the photo-detecting sensor head 261 are arranged in such a manner that the distance between the strings S1 to S88 and the optical path is constant.

Figure 5:
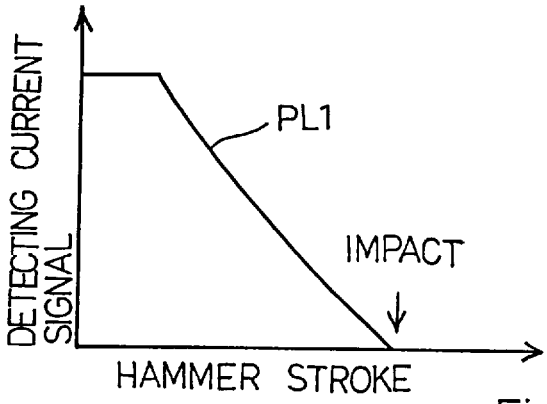
FIG. 5 is a graph showing the photo-current produced by a photo-detecting diode in terms of the stroke of a hammer assembly.
Figure 6:
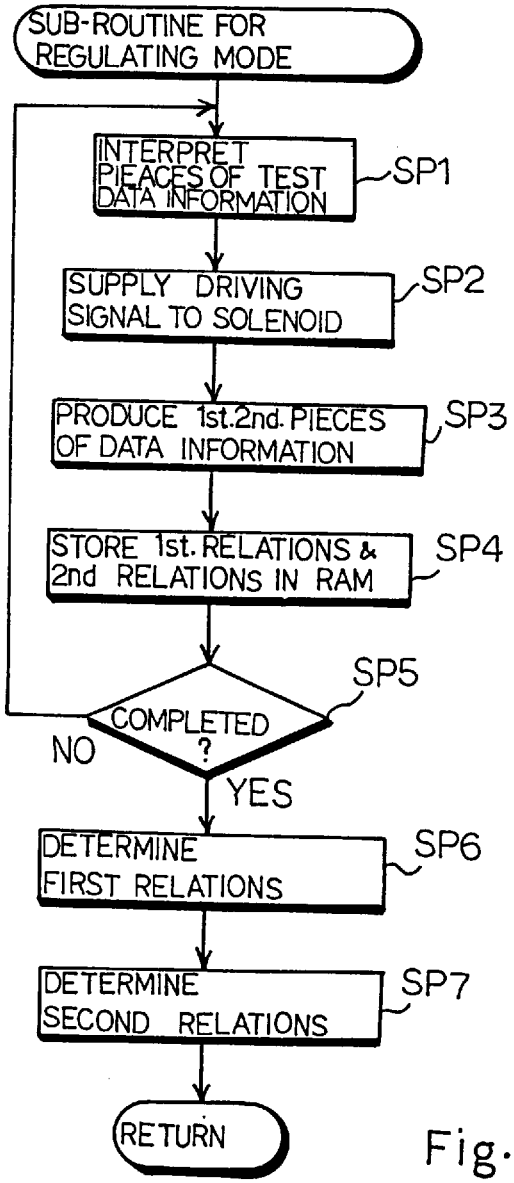
FIG. 6 is a flow chart showing a sub-routine program for a regulating mode.

In this situation, when one of the hammer assemblies H1 to H88 is driven for rotation, the hammer assembly gradually interrupts the light beam LB, and decreases the amount of incident light. The photo-detecting diode 258 changes the amount of photo-current as indicated by plots PL1 in FIG. 5, and the photo-current specifies the current hammer position on the trajectory between the home position and the impact point. The analog-to-digital converter 255*b* converts the amount of photo current or the detecting current signal DT1 into the digital detecting current signal DDT1, and the digital current signal DDT1 also specifies the current hammer position.

The data processor 251 periodically checks the second interface 255 to see whether or not any one of the hammer assemblies H1 to H88 changes the current hammer position. If a hammer assembly changes the current hammer position, the data processor 251 calculates the hammer velocity. In this instance, when the digital detecting current signal DDT1 is decreased to zero, the hammer assembly strikes the associated string, and the data processor 251 determines the impact timing.

Key Sensors

The key position sensors 263 are respectively associated with the black/white keys K1 to K88, and each key position sensor 263 is implemented by the combination of a shutter plate 263*a* and two photo-interrupters 263*b*/263*c* (see FIG. 1). The photo-interrupters 263*b*/263*c* are provided along the trajectory of the shutter plate 263, and the shutter plate 263*a* sequentially interrupts the light beams produced by the photo-interrupters 263*b*/263*c*. The photo-currents from the photo-interrupters 263*b*/263*c* form two-bit key position signal KP1, and the key position signals KP1 are supplied to the key scanning circuit 256*a*. The key scanning circuit 256*a* sequentially identifies the key position sensors 263, and allows the data processor 251 to sequentially fetch the key position signals KP1.

In this instance, when the shutter plate 263*a* interrupts the light beam of the photo-interrupter 263*b*, the data processor acknowledges that a player depresses the associated black/white key. The data processor 251 calculates the key velocity from the lapse of time between the interruption of the upper photo-interrupter 263*b* and the interruption of the second photo-interrupter 263*c*.

Programs

As described hereinbefore, the central processing unit 251*a* sequentially fetches the programmed instruction codes stored in the read only memory 251*b*, and repeats a main routine program. When a person plays a tune on the keyboard musical instrument in the acoustic sound mode, the central processing unit 251*a* stands idle.

Regulating Mode

When the player instructs the controller 250 to establish the first relations and the second relations, the keyboard musical instrument enters into the regulating mode, and executes a sub-routine program for the regulating mode. The central processing unit 251*a* reads out the pieces of test data information from the read only memory 251*b*, and interprets the pieces of test data information as by step SP1. The pieces of test data information may be coded into any kind of data format. However, the pieces of test data information contain at least a key-on representative of depressing a key, a key-off representative of release of the depressed key, a key code assigned to the depressed/released key, a key-on timing representative of lapse of time from the previous key-on, a key-off timing representative of lapse of time from the previous key-off and the velocity value representative of the strength of impact. Only one light beam LB is shared between all the hammer assemblies H1 to H88, and the solenoid driver 254*a* supplies the driving signal to the solenoids 230*a* in such a manner that two hammer assemblies do not concurrently interrupt the light beam LB. In this instance, each of the black/white keys is driven at three kinds of velocity value, i.e., "pp", "mf" and "ff", because the delay between the key-on timing and the impact timing is variable depending upon the velocity value. The key motion at each velocity value is repeated five times so as to eliminate error data from the result. The velocity value and the repetition may be appropriately changed.

The central processing unit 251*a* determines the electric power of the driving signal to be supplied to one of the solenoids 230*a* and a timing to supply it to the selected solenoid on the basis of the pieces of test data information. The electric power and the timing are written into the random access memory 251*c*.

Figure 7:
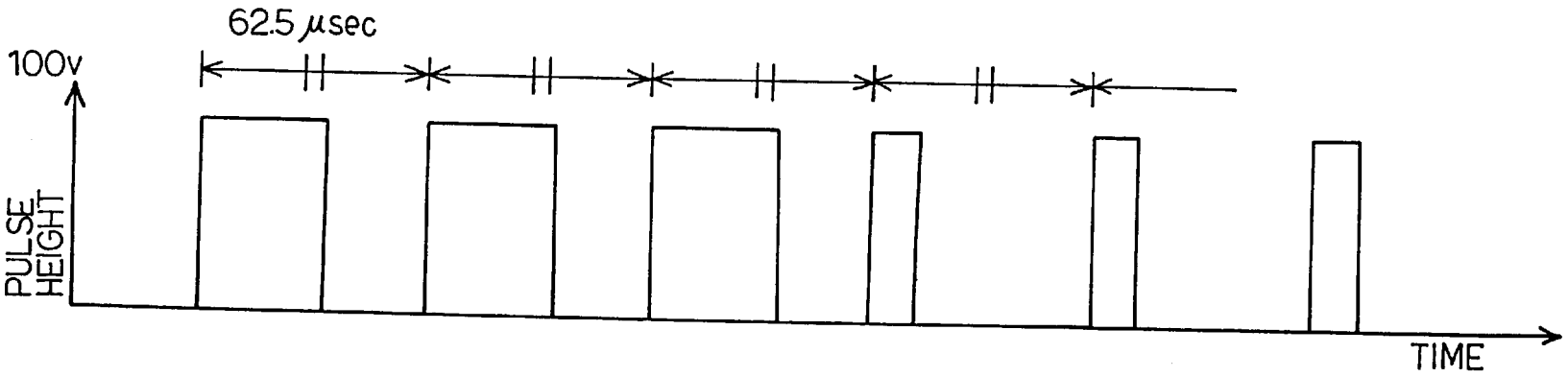
FIG. 7 is a view showing the waveform of a driving signal supplied to a solenoid-operated key actuator.

Subsequently, the solenoid driver 254*a* receives the instructions from the central processing unit 251*a*, and regulates the driving signal to the electric power determined at step SP1. The driving signal has a kind of PWM (Pulse Width Modulation) waveform shown in FIG. 7. The PWM waveform has a pulse period of 62.5 microsecond, and the duty factor is varied depending upon the electric power to be expected. The solenoid driver 254*a* supplies the driving signal to the solenoid 230*a* associated with one of the black/white keys H1 to H88 as by step SP2. Then, the solenoid-operated key actuator projects the plunger, and the causes the black/white key to turn.

The black/white key actuates the associated key action mechanism, and the key action mechanism drives the associated hammer assembly to turn. While the solenoid-operated key actuator is projecting the plunger, the black/white key changes the current position, and the key position sensor 263 reports the current key position through the key scanning circuit 256*a* to the central processing unit 251*a*. The hammer assembly also changes the current hammer position during the projection of the plunger, and gradually interrupts the light beam LB. When the hammer assembly perfectly interrupts the light beam LB, the hammer assembly strikes the associated string 105. The hammer sensor 240 reports the current hammer position through the second interface 255 to the central processing unit 251*a*, and the central processing unit 251*a* analyzes the variation of the current hammer position. The central processing unit 251*a* produces the first pieces of data information representative of the hammer motion as by step SP3, and the first pieces of data information contain the hammer velocity and the impact timing.

The central processing unit 251*a* further analyzes the variation of the current key position, and produces the second pieces of data information representative of the key motion. Some second pieces of data information represent the key-on timing and the key velocity.

Subsequently, the central processing unit 251*a* combines the final hammer velocity/the impact timing with the key velocity/key-on timing for the key code of the selected black/white key, and establishes first preliminary relations between the hammer motion and the key motion. The central processing unit 251*a* combines the hammer velocity/impact timing with the electric power for the key code of the selected black/white key, and establishes second preliminary relations between the hammer motion and the magnitude of the driving signal. The first preliminary relations and the second preliminary relations are stored in the random access memory 251*c* as by step SP4.

The central processing unit 251*a* proceeds to step SP5 to see whether or not all the black/white keys H1 to H88 are driven at the three kinds of velocity value. If the answer at step SP5 is given negative, the central processing unit 251*a* returns to step SP1, and reiterates the loop consisting of steps SP1 to SP5 until the answer at step SP5 is given affirmative. When the answer at step SP5 is changed to affirmative, the first relations and the second relations are stored in the random access memory 251*c*.

Subsequently, the central processing unit 251*a* proceeds to step SP6. The central processing unit 251*a* calculates time delay between the key-on timing and the impact timing, and determines a representative final hammer velocity from the five calculated values of the final hammer velocities for each black/white key. The representative final hammer velocity Hv may be an average of the five calculated values of the final hammer velocity. Similarly, a representative key velocity is determined for each black/white key. The delay time, the representative hammer velocity, the representative key velocity and the key code for each black/white key form the first relations.

Subsequently, the central processing unit 251*a* calculates time delay between the supply of the driving signal and the impact timing. The time delay is called as "attack delay". As described hereinbefore, each of the black/white keys is driven at thee kinds of electric power, and the attack delay is calculated for each of the thee kinds of electric power. The relation between the representative final hammer velocity Hv and the electric power is indicated by plots PL2 in FIG. 8A, and the attack delay ΔT is plotted in terms of the electric power as indicated by plots PL3 in FIG. 8B.

Figure 8A:
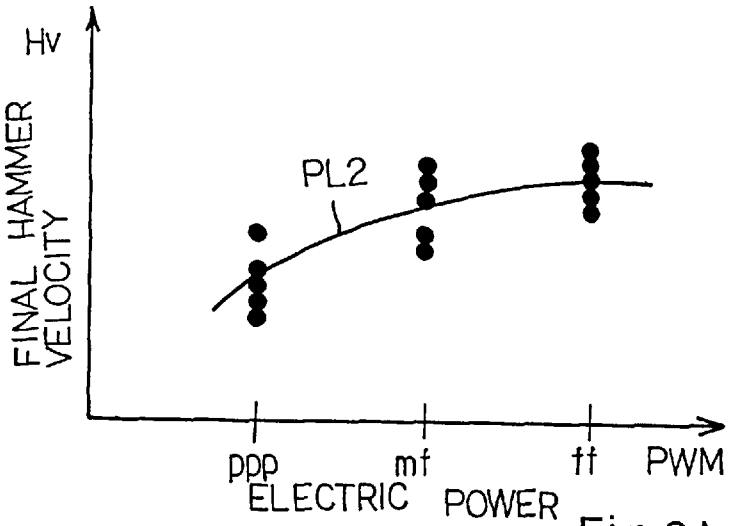
FIG. 8A is a graph showing the relation between a final hammer velocity and an electric power for one of the keys.
Figure 8B:
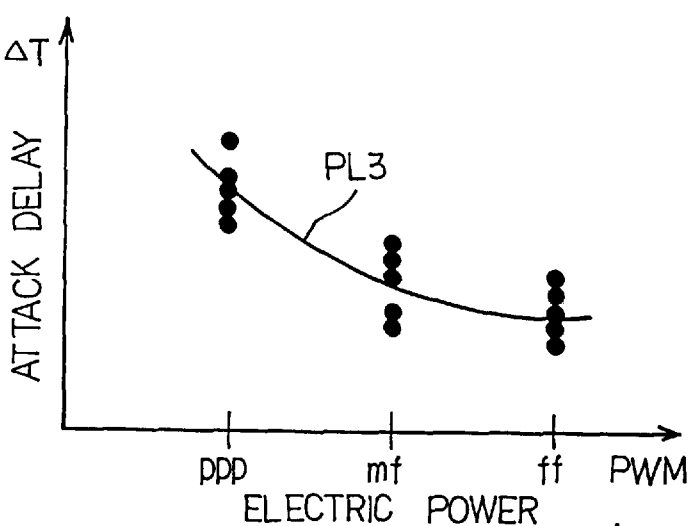
FIG. 8B is a graph showing the relation between an attack delay and the electric power for one of the keys.
Figure 8C:
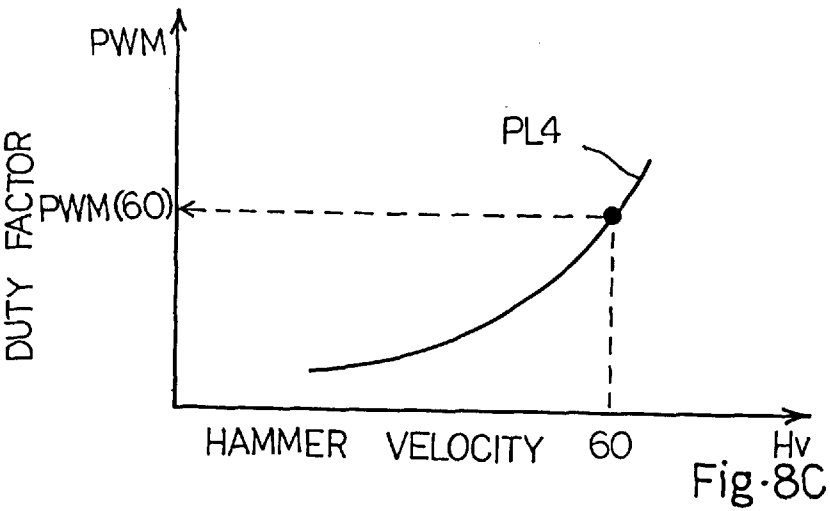
FIG. 8C is a graph showing the relation between a duty factor and the final hammer velocity.
Figure 8D:
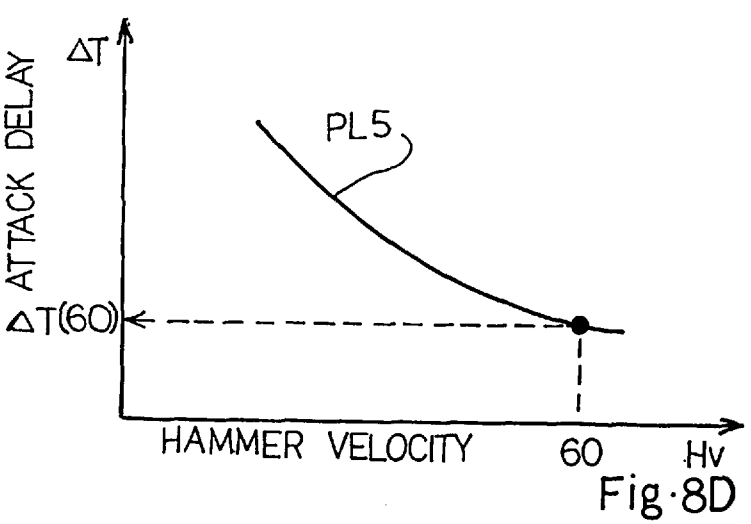
FIG. 8D is a graph showing the relation between the attack delay and the final hammer velocity.

Subsequently, the central processing unit 251*a* modifies the relations shown in FIGS. 8A and 8B, and determines the second relations as by step SP7. FIGS. 8C and 8D illustrate the second relations. The duty factor PWM is plotted in terms of the representative final hammer velocity Hv as indicated by plots PL4, and the attack delay ΔT is plotted in terms of the representative final hammer velocity Hv as indicated by plots PL5 in FIG. 8D. In order to obtain the final hammer velocity Hv of "60", the solenoid driver 254*a* regulates the duty factor of the driving signal to PWM(60), and the attack delay ΔT at hammer velocity of "60" is ΔT(60). The first and second relations are stored in the built-in memory 252 implemented by an electrically erasable and programmable read only memory.

Upon completion of step SP6, the central processing unit 251*a* returns to the main routine program.

Recording Mode

Figure 9:
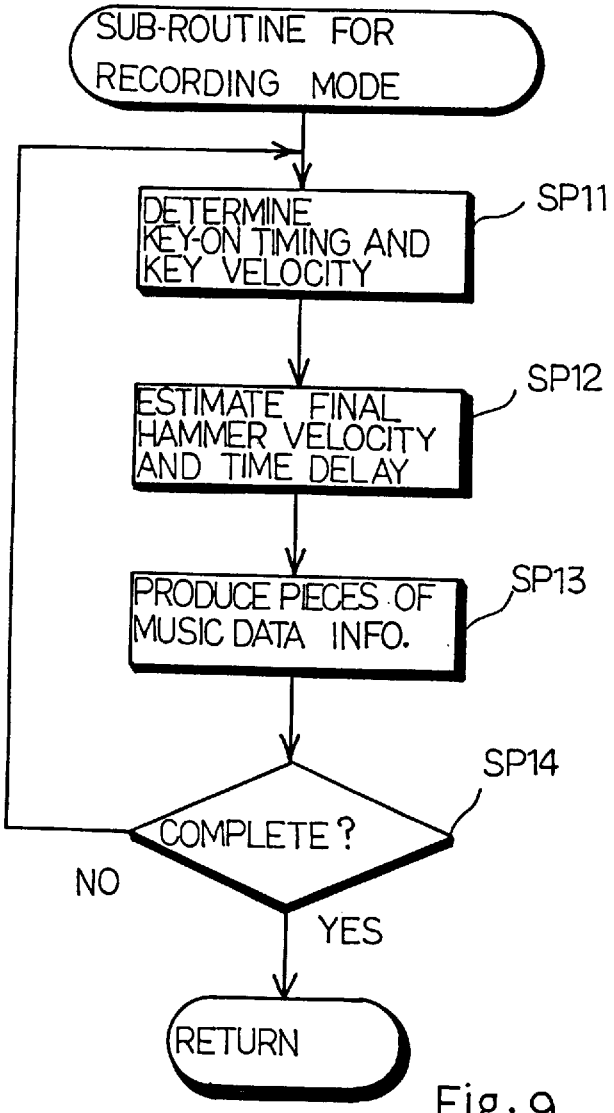
FIG. 9 is a flow chart showing a sub-routine program for a recording mode.

When the player wants to record his performance, he instructs the controller 250 to enter into the recording mode, and the central processing unit 251*a* is branched from the main routine program to a sub-routine program for the recording mode shown in FIG. 9. The solenoid driver 254*a*, the solenoids 230*a*, the LED driver 255*a*, the analog-to-digital converter 255*b*, the light emitting diode 257, the light emitting sensor head 260, the photo-detecting sensor head 261 and the photo-detecting diode 258 stand idle during the recording mode. While the player is playing a tune on the keyboard 101, the central processing unit 251*a* produces the pieces of music data information representative of the performance, and the pieces of music data information are stored in the random access memory 251*c*.

The player is assumed to depress a key H1 in the performance. The associated key position sensor 263 detects the downward motion of the key H1, and periodically reports the current key position of the key H1 through the key scanning circuit 256*a* to the central processing unit 251*a*. The central processing unit 251*a* identifies the depressed key with a key code, and periodically receives the current key position. When the shutter plate 263*a* interrupts the upper photo-interrupter 263*b*, the central processing unit 251*a* acknowledges the downward motion of the key H1, and determines the key-on timing. The central processing unit 251*a* calculates the key velocity on the basis of two current key positions and the lapse of time therebetween. In this way, the central processing unit 251*a* determines the key-on timing and the key velocity as by step SP11.

Subsequently, the central processing unit accesses the first relations stored in the built-in memory 252, and estimates the final hammer velocity and the time delay between the key-on timing ad the impact timing for the depressed key H1 on the basis of the first relations as by step SP12. The first relations between the key velocity, the final hammer velocity and the time delay are usually discrete values. If the key velocity calculated at step SP11 is an intermediate value between two discrete values, the central processing unit 251*a* calculates the final hammer velocity and the time delay for the depressed key H1 by using a suitable interpolation.

Subsequently, the central processing unit 251*a* determines the impact timing for the depressed key H1 on the basis of the key-on timing and the time delay between the key-on timing and the impact timing. The central processing unit 251*a* further calculates the duration data from the key-on/key-off timing immediately before the key-on timing for the key H1 and the impact timing. The duration data and the final hammer velocity are coded together with the key code. Thus, the central processing unit 251*a* produces the piece of music data information as by step SP13, and stores the piece of music data information in the random access memory 251*c*.

Subsequently, the central processing unit 251*a* checks a manipulating board (not shown) of the controller 250 to see whether or not the player completes the performance. If the player continues the fingering on the keyboard 101, the central processing unit 251*a* returns to step SP11, and reiterates the loop consisting of steps SP11 to SP14 until the player instructs the controller 250 to store the pieces of music data information into the information storage medium 253*a*. While the central processing unit 251*a* is repeatedly reiterating the loop, the player releases the depressed key H1. Then, the central processing unit 251*a* immediately calculates the duration data for the released key without execution of steps SP11 and SP12, and the duration data is coded together with the key code. The pieces of music data information are also stored in the random access memory 251*c*.

When the player instructs the controller 250 to store the pieces of music data information into the information storage medium 253*a*, the central processing unit 251*a* transfers the pieces of music data information to the external memory driver 253, and the external memory driver 253 writes the pieces of music data information into the information storage medium 252*a*. Thereafter, the central processing unit returns to the main routine program.

Playback Mode

Figure 10:
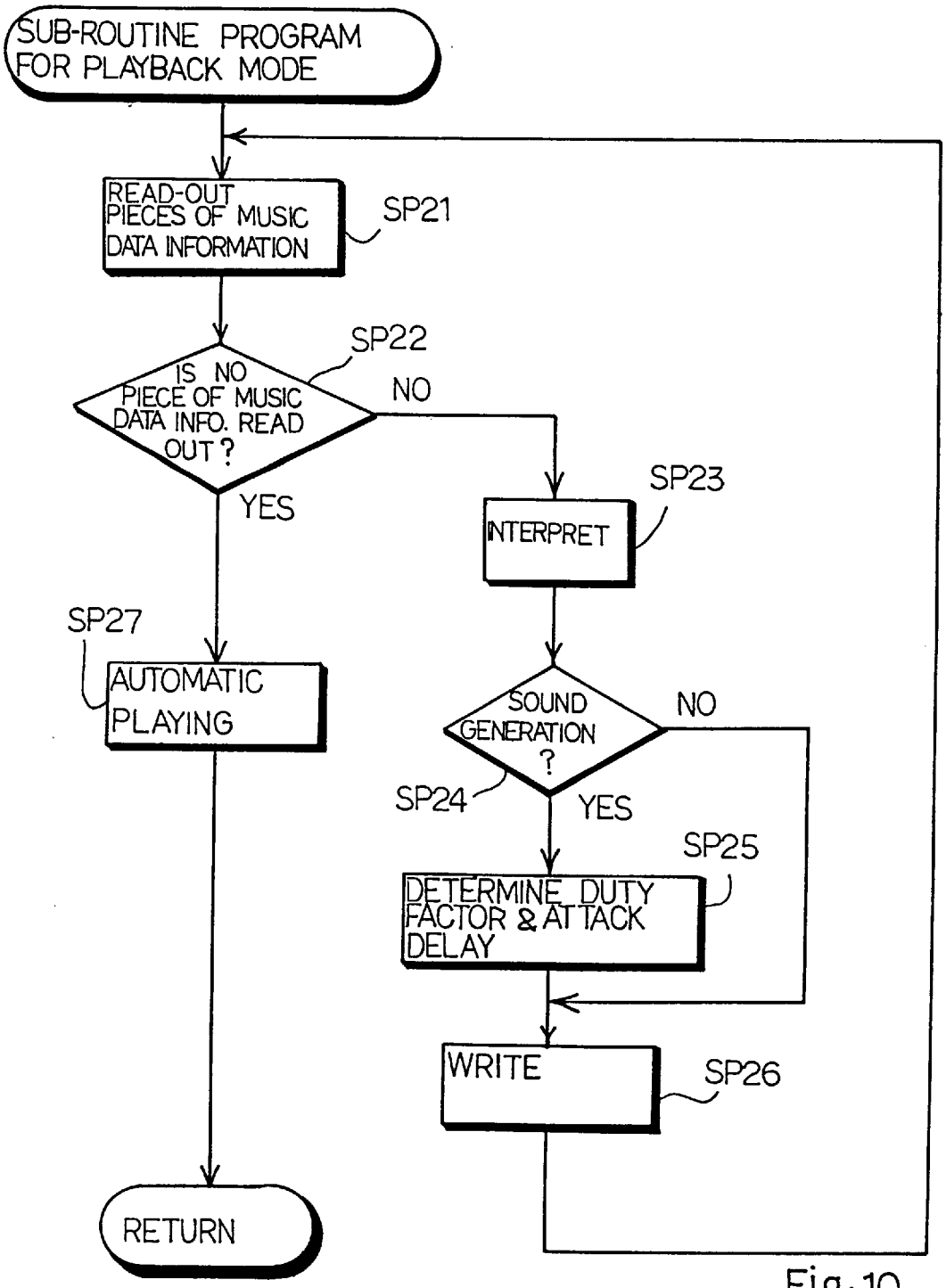
FIG. 10 is a flow chart showing a sub-routine program for a playback mode.

When the player wants to listen the performance stored in the information storage medium 253*a*, the central processing unit 251*a* is branched from the main routine program to a sub-routine program for the playback mode shown in FIG. 10. In the playback mode, the LED driver 255*a*, the analog-to-digital converter 255*b*, the light emitting diode 257, the light emitting sensor head 260, the photo-detecting sensor head 261, the photo-detecting diode 258, the key scanning circuit 256*a* and the key position sensors 263 stand idle.

The central processing unit 251*a* instructs the external memory driver 253 to transfer a piece of music data information from the information storage medium 253*a* to the random access memory 251*c* as by step SP21, and asks the external memory driver if no piece of music data information has been read out from the information storage medium 253*a* as by step SP22. If the answer at step SP22 is given negative, a piece of music data information is supplied to the central processing unit 251*a*, and the central processing unit 251*a* interprets the piece of music data information as by step SP23. The central processing unit 251*a* checks the piece of music data information to see whether the piece of music data information contains an instruction for generating a sound as by step SP24. If the answer at step SP24 is given affirmative, the central processing unit 251*a* accesses the built-in memory 252 so as to determine the duty factor PWM and the attack delay ΔT for the key to be depressed on the basis of the second relations as by step SP25. The central processing unit 251*a* changes the duration data indicative of the lapse of time from the previous instruction to the given instruction, and writes the modified duration data and the velocity value into the random access memory 251*c* as by step SP26. The modification of the duration data will be described hereinlater. If the answer at step SP24 is given negative, the central processing unit 251*c* proceeds to step SP26 without execution of step SP25. In this way, the central processing unit 251*a* reiterates the loop consisting of steps SP22 to SP26 until the answer at step SP22 is changed to affirmative.

When the answer at step SP22 is given affirmative, the central processing unit 251*a* treated all the pieces of music data information with steps SP23 to SP26, and proceeds to step SP27. The central processing unit accesses the music data information stored in the random access memory 251*c*, and instructs the solenoid driver 254*a* to selectively supply and stop the driving signal to the solenoids 230*a*.

The central processing unit 251*a* takes the attack delay into account, and supplies the instruction for the driving signal to the solenoid driver 254*a*. For this reason, the solenoid driver 254*a* produces the driving signal with the given duty factor at appropriate timing, and the solenoid-operated key actuator 230 projects the plunger at suitable timing earlier than the impact timing by the attack delay. Thus, the keyboard musical instrument according to the present invention exactly reproduces the original performance represented by the pieces of music data information. Upon completion of the playback, the central processing unit 251*a* returns to the main routine program.

Figure 11:
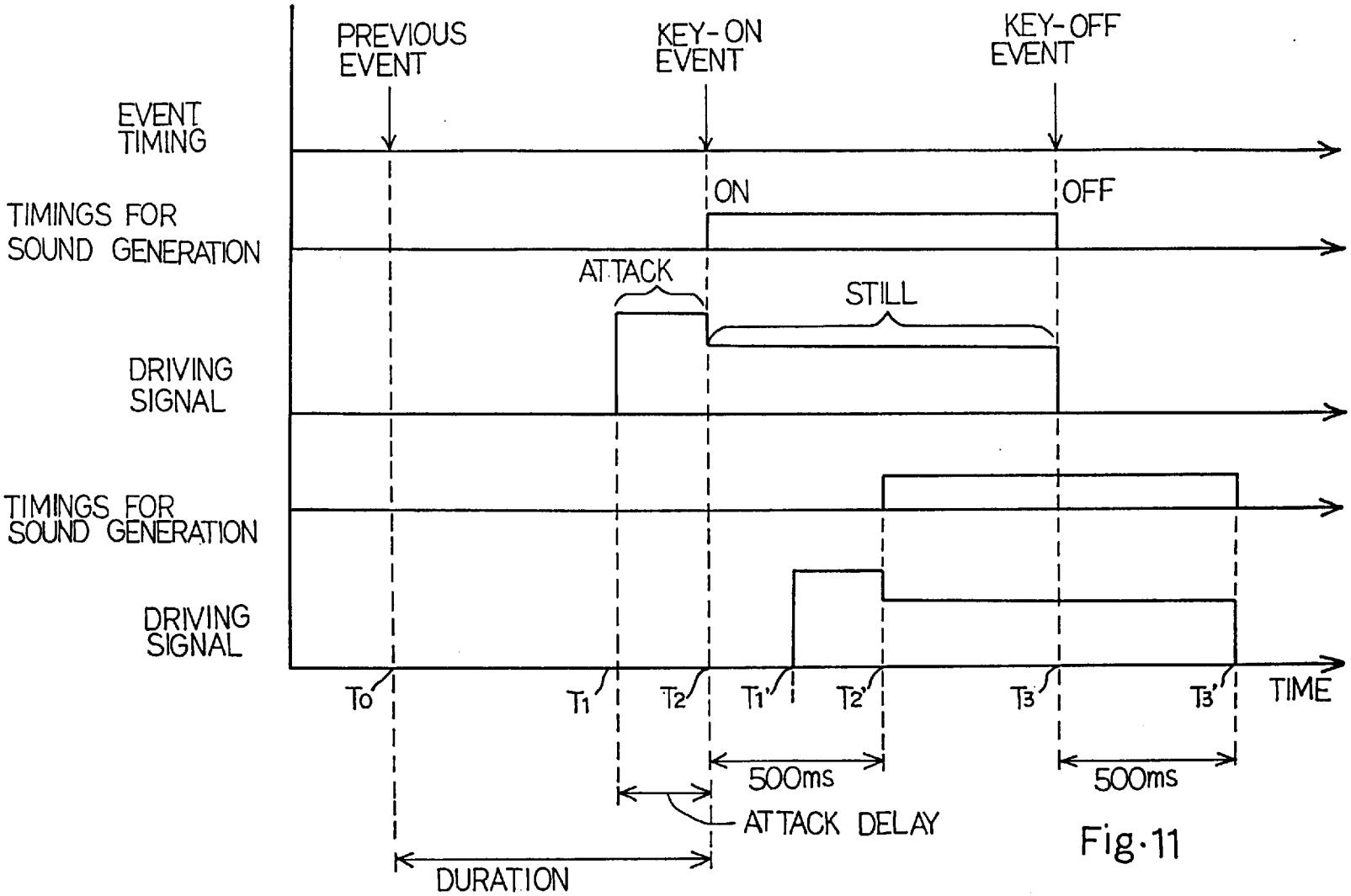
FIG. 11 is a timing chart for a playback.

FIG. 11 illustrates event timings and the driving signal in the playback mode. The previous event takes place at time T0. A piece of music data information is indicative of production of the sound at time T2, and the solenoid driver 254*a* is requested to supply the driving signal at time T1. In order to determine the time T1, the central processing unit 251*a* calculates the difference between the duration and the attack delay, and modifies the duration data. The driving signal rises at time T1, and falls at time T3. The pulse height between T1 and T2 is higher than the pulse height between T2 and T3. The time period between T1 and T2 is called as attack period, and the time period between T2 and T3 is called as still period. The pulse height in the attack period is determined on the basis of the final hammer velocity Hv, and the pulse height in the still period is constant regardless of the final hammer velocity and the key code. The driving signal in the still period causes the solenoid-operated key actuator 230 to maintain the depressed black/white key at the end position after the strike at the string. Upon completion of the still period, the driving signal falls, and the depressed black/white key starts to return toward the end position. Then, the damper mechanism is brought into contact with the string, and extinguishes the sound.

The attack delay is different between the black/white keys 106/107 and between the velocity values or the values of the final hammer velocity. The relation between the final hammer velocity and the attack delay is determined for each of the black/white key 106/107 as shown in FIG. 8D, and is stored in the built-in memory 252 as a part of the second relations.

As will be appreciated from the foregoing description, the keyboard musical instrument according to the present invention determines the first relations and the second relations in the regulating mode, and the hammer motion is estimated from the key motion on the basis of the first relations in the recording mode. The hammer assemblies H1 to H88 are sequentially driven for rotation in the regulating mode, and, for this reason, the keyboard musical instrument requires only one optical detector 257/260/261/258 for determining the hammer motion of each hammer assembly. Thus, the electric system 200 is simple.

While the keyboard musical instrument according to the present invention is expected to reproduce a performance represented by the pieces of music data information, the controller 251 modifies the pieces of music data information with the second relations, and requests the solenoid driver 254*a* to rise the driving signal earlier than the key-on timing by the attack delay. The attack delay is determined in the regulating mode on the basis of the piece of test data information and the hammer motion, and the individuality of each key/key action mechanism/hammer assembly is taken into account. If a player periodically requests the keyboard musical instrument to execute the sub-routine program for the regulating mode, uneven aged deterioration is eliminated from the first and second relations, and the keyboard musical instrument faithfully reproduces an original performance at all times.

If the pieces of music data information are normalized in the recording mode and the normalized pieces of music data information are individualized in the playback mode, the keyboard musical instrument faithfully reproduce an original performance recorded by using different keyboard musical instrument.

Although a particular embodiment of the present invention has been shown and described, it will be obvious to those skilled in the art that various changes and modifications may be made without departing from the spirit and scope of the present invention.

For example, the light emitting diode array 257 may be replaced with any kind of light source radiating any kind of light such as, for example, laser light or infra-red light.

The key position sensor 263 may have a shutter plate with a plurality of holes and a single photo-coupler. The photo-coupler sequentially detects the holes during the motion of the black/white key.

A keyboard musical instrument according to the present invention may have one of the recorder and the playback controller.

In the above described embodiment, when the hammer assembly perfectly interrupts the light beam, the hammer assembly strikes the string. However, the central processing unit may calculates the impact timing Tx as Tx=Ti+D/V where Ti is a timing when the light beam is perfectly interrupted, D is the distance between the light beam and the string and V is the hammer velocity.

Figure 12:
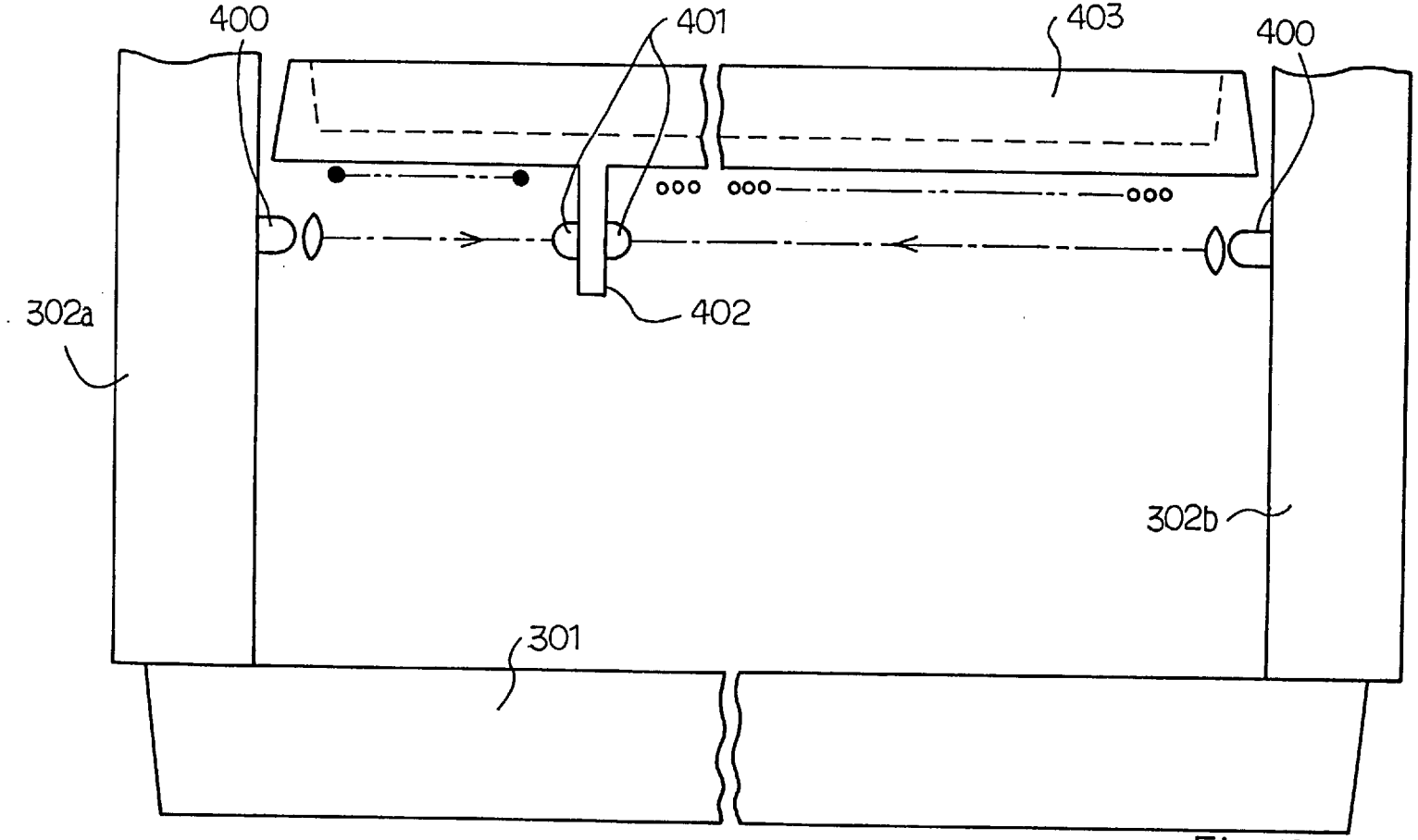
FIG. 12 is a front view showing an optical detector incorporated in a first modification of the keyboard musical instrument.

If a stationary member such as a rib of a frame interrupts the light beam LB, a through-hole may be formed in the stationary member so as to allow the light beam to pass therethrough. Otherwise, two pairs of light-emitting sensor head/photo-detecting sensor head 400/401 are installed in the acoustic piano as shown in FIG. 12. The light-emitting sensor heads 400 are attached to the side arms 302*a*/302*b*, respectively, and the photo-detecting sensor heads 401 are attached to both side surfaces of the rib 402 projecting from the frame 403.

In the above described embodiment, the central processing unit 251*a* determines the key-on timing and the key velocity. However, only the key-on timing may be determined so as to estimate the impact timing. The key motion may be detected at more than two points or only one point.

Figures 13, 14:
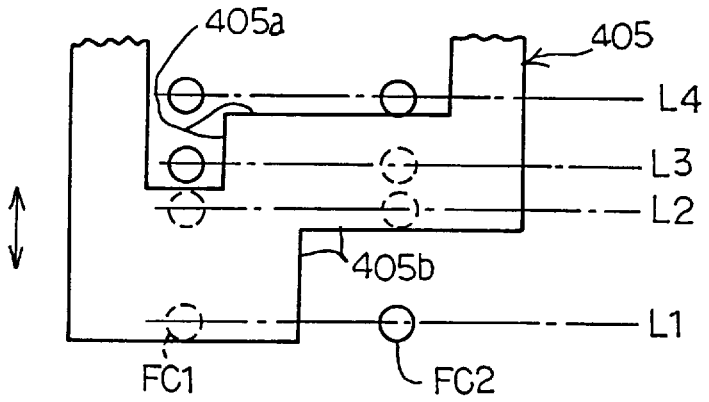
FIG. 13 is a side view showing the configuration of a shutter plate incorporated in a second modification.
FIG. 14 is a view showing relative positions detectable by the shutter plate and two photo-interrupters.

A shutter plate 405 shown in FIG. 13 may form a part of the key position sensor 263. Steps 405*a* and 405*b* are formed in the shutter plate 405, and two light beams FC1/FC2 are selectively interrupted by the shutter plate 405, and the key position sensor discriminates the four relative positions L1, L2, L3 and L4 as shown in FIG. 14. The shutter plate 405 and the two photo-interrupters for the light beams FC1/FC2 are available for the key position sensor 263, and the central processing unit 251*a* exactly estimates the hammer velocity on the basis of the key velocity between the points L1 and L2 and between the points L3 and L4. In this instance, even if the player changes the force exerted on the black/white key on the way to the end position, the central processing unit 251*a* takes the change into account, and exactly estimates the hammer motion.

The built-in memory 252 may be implemented by another kind of non-volatile memory or a battery backup random access memory.

Any kind of light such as visible light, laser light and infra-red light may be used in the light emitting diode and the photo-detecting diode. An analog sensor is also available for the hammer sensor.

The hammer sensor may detect the impact timing only, and the final hammer velocity may experientially correspond to the key velocity of each key. In this instance, the light beam LB would be minimized. An acceleration sensor may be used for detecting the hammer velocity.

An acoustic piano, a hammer stopper and the electric system 200 may form a keyboard musical instrument according to the present invention. The keyboard musical instrument is called as a silent piano. In this instance, a player sequentially depresses the black/white keys, because the silent piano is not equipped with a solenoid-operated key actuator. Other wise, while the player is performing a tune on the keyboard, the controller determines the first relations, and rewrites the first relation into the built-in memory.

In the above described embodiment, the duration data is modified with the attack delay through steps Sp23 to SP26, and, thereafter, the solenoid driver produces the driving signal so as to selectively supply it to the solenoid-operated key actuators. However, a third modification may not modify the duration data. In this instance, a constant delay such as 500 millisecond is introduced between the key-on timings T2 and T2' and between the key-off timings T3 and T3' (see FIG. 11), and the driving signal rises at time T1' earlier than the key-on timing T2' by the attack delay. Although time delay is introduced into the playback, the relative relation of the sounds is identical with that of the original performance.

What is claimed is:

1. A keyboard musical instrument comprising an acoustic keyboard instrument including a plurality of keys movable between respective rest positions and respective end positions, a plurality of vibrating means for producing acoustic sounds having respective notes of a scale, and a plurality of striking means selectively driven by said plurality of keys so as to cause said plurality of vibrating means to produce said acoustic sounds; and an electric system including a first detecting means activated for producing first pieces of data information representative of first motions of said plurality of keys, a second detecting means activated for producing second pieces of data information representative of second motions of said plurality of striking means, a first analyzing means analyzing said first motions and said second motions for determining first relations therebetween, and a music data generating means modifying said first pieces of data information with said first relations for producing pieces of music data information representative of a performance on said plurality of keys.

2. The keyboard musical instrument as set forth in claim 1, in which said electric system selectively enters into a regulating mode and a first performance mode for recording a performance, said first detecting means and said music data generating means are activated in both of said regulating mode and said first performance mode, and said second detecting means and said first analyzing means are activated in said regulating mode.

3. The keyboard musical instrument as set forth in claim 1, wherein said detecting means detects each of said first motions including a first velocity of one of said plurality of keys and a key-on timing at which said one of said plurality of keys is decided to be moved, and said detecting means detects each of said second motions including a second velocity of one of said plurality of striking means and an impact timing at which said one of said plurality of striking means strikes associated one of said plurality of vibrating means.

4. The keyboard musical instrument as set forth in claim 3, in which said first relations contain at least third pieces of data information representative of a relation between a time delay between said key-on timing and said impact timing, said first velocity, said second velocity and a key code assigned to said one of said plurality of keys.

5. The keyboard musical instrument as set forth in claim 4, in which said first analyzing means estimates said time delay and said second velocity for a given first velocity so as to produce one of said pieces of music data information.

6. The keyboard musical instrument as set forth in claim 2, in which said electric system further has a second performance mode for reproducing said performance represented by said pieces of music data information, and further includes a plurality of actuators respectively associated with said plurality of keys and responsive to a driving signal in said regulating mode and said second performance mode for selectively moving the associated keys, a second analyzing means activated in said regulating mode and analyzing said second motions and a piece of test data information for determining second relations therebetween, and an automatic playing means responsive to said piece of test data information in said regulating means for producing said driving signal and modifying pieces of music data information with said second relations in said second performance mode for producing said driving signal.

7. The keyboard musical instrument as set forth in claim 5, in which said electric system further has a second performance mode for reproducing said performance represented by said pieces of music data information, and further includes a plurality of solenoid-operated actuators respectively associated with said plurality of keys and responsive to a driving signal in said regulating mode and said second performance mode for selectively moving the associated keys, a second analyzing means activated in said regulating mode and analyzing said second motions and a piece of test data information for determining second relations therebetween, and an automatic playing means responsive to said piece of test data information in said regulating means for producing said driving signal and modifying pieces of music data information with said second relations in said second performance mode for producing said driving signal.

8. The keyboard musical instrument as set forth in claim 7, in which said second relations contain at least fourth pieces of data information representative of a relation between said second velocity, a magnitude of said driving signal required for achieving said second velocity and an attack delay between said impact timing and a timing at which said driving signal is supplied to one of said plurality of actuators.

9. The keyboard musical instrument as set forth in claim 1, in which said second detecting means comprises a light emitting element and a light-to-electric current converting element for producing a light beam crossing trajectories of at least two of said plurality of striking means.

10. The keyboard musical instrument as set forth in claim 9, in which said light beam crosses the trajectories of said plurality of striking means.

11. A keyboard musical instrument comprising an acoustic keyboard instrument including a plurality of keys movable between respective rest positions and respective end positions, a plurality of vibrating means for producing acoustic sounds having respective notes of a scale, and a plurality of striking means selectively driven by said plurality of keys so as to cause said plurality of vibrating means to produce said acoustic sounds; and an electric system selectively entering into a regulating mode and a performance mode for reproducing a performance on said plurality of keys, and including a plurality of actuators respectively associated with said plurality of keys and responsive to a driving signal in said regulating mode and said performance mode for selectively moving the associated keys, a detecting means activated in said regulating mode for producing pieces of data information representative of motions of said plurality of striking means, an analyzing means analyzing said motions of said plurality of striking means and a piece of test data information in said regulating mode for determining relations therebetween, and an automatic playing means responsive to said piece of test data information in said regulating means for producing said driving signal and modifying pieces of music data information representative of said performance with said relations in said performance mode for producing said driving signal.

12. A recorder incorporated in a keyboard musical instrument together with a plurality of keys movable between respective rest positions and respective end positions, a plurality of vibrating means for producing acoustic sounds having respective notes of a scale and a plurality of striking means selectively driven by said plurality of keys so as to cause said plurality of vibrating means to produce said acoustic sounds, said recorder comprising a first detecting means activated for producing first pieces of data information representative of first motions of said plurality of keys, a second detecting means activated for producing second pieces of data information representative of second motions of said plurality of striking means, an analyzing means analyzing said first motions and said second motions for determining relations therebetween, and a music data generating means modifying said first pieces of data information with said relations for producing pieces of music data information representative of a performance on said plurality of keys.

13. The recorder as set forth in claim 12, in which said first detecting means and said music data generating means are activated in both of said regulating mode and said performance mode, and said second detecting means and said analyzing means are activated in said regulating mode.

14. A playback controller incorporated in a keyboard musical instrument together with a plurality of keys movable between respective rest positions and respective end positions, a plurality of vibrating means for producing acoustic sounds having respective notes of a scale and a plurality of striking means selectively driven by said plurality of keys so as to cause said plurality of vibrating means to produce said acoustic sounds, said playback controller selectively entering into a regulating mode and a performance mode, and including a plurality of actuators respectively associated with said plurality of keys and responsive to a driving signal in said regulating mode and said performance mode for selectively moving the associated keys, a detecting means activated in said regulating mode for producing pieces of data information representative of motions of said plurality of striking means, an analyzing means analyzing said motions of said plurality of striking means and a piece of test data information in said regulating mode for determining relations therebetween, and an automatic playing means responsive to said piece of test data information in said regulating means for producing said driving signal and modifying pieces of music data information representative of a performance on said plurality of keys with said relations in said performance mode for producing said driving signal.

* * * * *